United States Patent [19]

Hammelmann

[11] 4,409,920

[45] Oct. 18, 1983

[54] APPARATUS FOR TREATING SHIP HULLS

[76] Inventor: Paul Hammelmann, Zum Sundern 17, 4740 Oelde 1, Fed. Rep. of Germany

[21] Appl. No.: 284,451

[22] Filed: Jul. 17, 1981

[30] Foreign Application Priority Data

Jul. 22, 1980 [DE] Fed. Rep. of Germany ..... 3027677

[51] Int. Cl.[3] ..... B63B 59/06

[52] U.S. Cl. ..... 114/222; 118/305; 51/410

[58] Field of Search ..... 114/222, 45, 314; 118/108, 207, 305; 405/4; 51/410, 424

[56] References Cited

U.S. PATENT DOCUMENTS 3,396,492 8/1968 Schenck ..... 51/410

3,951,092 4/1976 van den Brock ..... 114/222

FOREIGN PATENT DOCUMENTS 2037149 7/1980 United Kingdom ..... 51/410

2037575 7/1980 United Kingdom ..... 114/222

*Primary Examiner*—Sherman D. Basinger

*Attorney, Agent, or Firm*—Michael J. Striker

[57] ABSTRACT

An apparatus for treating ships' hulls in a dry dock has a carriage movable horizontally on a longitudinal wall of the dry dock and having upper and lower portions, a control cabin located on the upper portion of the carriage, working platform or device connected with the carriage and pivotable about at least one vertical and horizontal axis, working aggregates for operating the apparatus, a container located in the region of the lower portion of the carriage under water in filled condition of the dry dock and being water-tight and accommodating the working aggregates, and a plurality of conduits including at least one fresh air supply conduit extending to the container and at least one exhaust gas and spent air discharge conduit extending from the container, wherein the conduits extend up to the upper portion of the carriage.

23 Claims, 10 Drawing Figures

4
115
10
41
110
210
3
310
141
40

11
14
160
42
30
410
43
60
41
8
81
110
80
82
3
13
50
5
213
17
305
116
1
115
12
210
310

41
1
118
212
515
110
115
20
60
112
21
116
18
80
83
81
82
416
216
8
112
22
115
12
80
212
515
110
3

APPARATUS FOR TREATING SHIP HULLS

BACKGROUND OF THE INVENTION

The present invention relates to an apparatus for treating ship hulls, or more particularly for servicing, repairing, cleaning and/or painting of ship hulls.

Apparatuses of the above-mentioned general type are known in the art. A known apparatus has a carriage provided with rollers and a container and is movable on a longitudinal wall of a dry dock, wherein a control cab is arranged above the carriage, at least one internal combustion engine and hydraulic aggregate are provided, at least one working platform and/or working device is carried by a mast rotatable about at least one vertical and at least one horizontal axis. The above-described apparatus is disclosed, for example, in the German Offenlegungsschrift No. 2,849,079 published on May 22, 1980. The apparatus disclosed therein has a water-receiving container mounted on the carriage and having a water inlet opening which is provided at the side facing toward the dock wall in the upper region and extending approximately over the entire length of the container. A dock water conduit having a plurality of discharge locations is arranged opposite to the water inlet opening. The faucets of these locations can be opened by control means provided in the apparatus in response to sensing of water level in the container.

Another apparatus is proposed in U.S. Pat. No. 3,951,092. In this apparatus the carriage is provided with a platform arranged in the region adjacent to the dock bottom, and a paint pump, paint container and further paint-spraying devices with required auxiliary equipment are mounted on the platform after the discharge of the water from the interior of the dock. These aggregates are mounted on the platform only during the painting of the ship and must be removed from the platform before filling of the dock. In the filled dock these aggregates must be placed outside of the dock bottom and then transported for a new use as well as mounted on the above-mentioned platform of the apparatus again.

SUMMARY OF THE INVENTION

Accordingly, it is an object of the present invention to provide an apparatus for treating ship hulls which avoids the disadvantages of the prior art.

More particularly, it is an object of the present invention to provide an apparatus in which the loading of the supply tanks, for example with diesel oil, hydraulic oil or paint, the servicing of the drive motors, the hydraulic station, the painting station and the power water station, the mounting of the carriage and the respective parts of the apparatus can be performed in a very inexpensive way.

In keeping with these objects and with others which will become apparent hereinafter, one feature of the present invention resides, briefly stated, in the fact that the apparatus has a container which is located in a lower portion of a movable carriage under water in condition of the filled dock and is water-tight, wherein the required aggregates such as internal combustion engines, hydraulic station, power water station and/or painting station and supply tank are arranged in the container, and at least one fresh air supply conduit and exhaust gas and spent cool air discharge conduit extend into and from the container respectively, and reach the upper region of the carriage.

In accordance with another advantageous feature of the present invention, a rail is arranged on the dock bottom and the container is mounted on the carriage in the vicinity of the lower rail. Thereby the water-tight container accommodating all essential aggregates of the apparatus assumes a small height relative to the dock bottom, so that without additional auxiliary means for overlapping of the height difference between the dock bottom and the aggregates, servicing of the aggregates and filling of the supply tanks can be performed. The mounting and dismounting of these aggregates from the dock bottom is also very simple.

The novel features which are considered as characteristic of the present invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
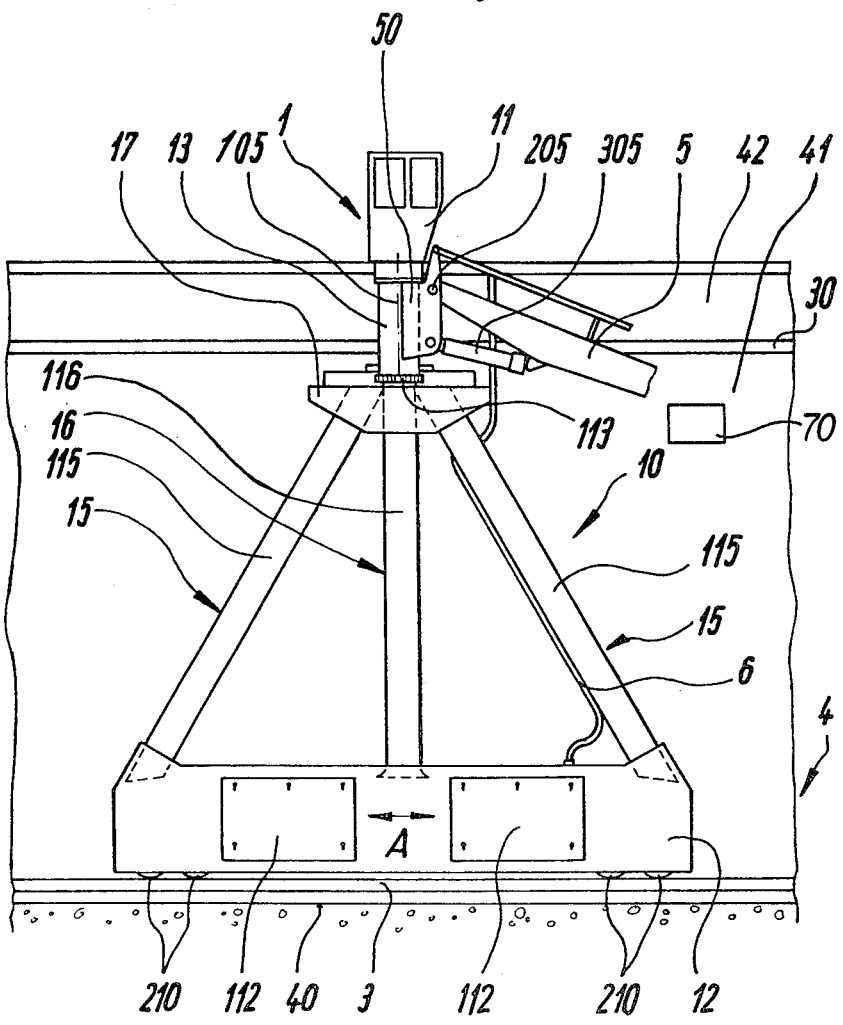
FIG. 1 is a front view of an apparatus for treating ship hulls in accordance with the present invention.

As can be seen from FIG. 1, an apparatus for treating ship hulls in dry docks is identified by reference numeral 1. The apparatus 1 is arranged on a vertical longitudinal wall 41 of a dry dock 4 and can move in the direction of the arrow A. The apparatus is utilized for servicing, repairing, cleaning and/or painting of hulls of a ship.

The apparatus has a carriage which is identified by reference numeral 10 and is provided with rollers. A control cabin 11 is arranged above the carriage 10. The carriage 10 carries a mast 5 which supports at its free end a conventionally designed working device or working platform, and the like (shown in FIG. 1 as rectangular box 70). The working platform or the working device can also be combined with one another. The mast 5 is pivotable about a vertical axis 105 which is shown in dash-dot line in FIG. 1, and is also pivotable about a horizontal axis 205. The mast 5 is displaceable by a control cylinder-and-piston unit 305. A parallel linkage 51 is associated with the mast 5.

A water-tight container 12 is arranged in the lower region of the carriage 10 so that it is located under water in the filled dock 4. Required aggregates 2 which are not shown in FIG. 1 are accommodated in container 12. For example, one or several internal combustion engines, a hydraulic station, and power water station and/or a painting station and a supply tank can be accommodated in the container 12. The water-tight container 12 has relatively great entry windows 112 so that when the dock is not filled, service work of the aggregates 2 can be performed.

Fresh air conduits 15 are associated with suction pipes of the motors which are not shown in FIG. 1. As can be seen from FIG. 1, the fresh air conduits 15 are formed as pipes 115. The pipes 115 for the fresh air are arranged in a V-shaped manner and extend up to the upper region of the apparatus. A conduit 16 extends between the conduits 15 up to the upper region of the apparatus and is formed for example also as a pipe 116 for discharging exhaust gas and spent cool air. The pipe 116 serves as a central support for the connection between the control cabin 11 and the water-tight container 12.

The water-tight container 12 has in its lower region rollers 210 with which the container 12 and the entire carriage 10 mounted thereon displace over a rail 3. The lower rail 3 associated with a chassis 110 can be offset from or located adjacent to a dock bottom 40 on a vertical dock longitudinal wall 41 over a console 141. This is more clearly shown in FIG. 3 inasmuch as the chassis 110 is illustrated there.

An upper rail 30 associated with the carriage 10 is mounted on the vertical longitudinal wall 41 of the dock and extends, similarly to the rail 3, advantageously over the entire vertical longitudinal wall of the dock. Thereby, the apparatus 1 for servicing, repairing, cleaning and/or painting of ship hulls has a maximum movement path and utilizes the entire length of the vertical longitudinal wall 41 of the dock so that an outrigger or mast 5 with its working platform and/or working device can extend outwardly beyond the dock longitudinal wall. As a result of this, there is a possibility that the dock bottom 40 is extended over the region of the vertical longitudinal wall 41 of the dock outwardly in the direction toward the embarkment side so that the working region of the apparatus is increased. The entire longitudinal wall 41 of the dock can be utilized as a guiding length to the end faces of the dock wall. In some cases, an intermediate outrigger and the like can be dispensed with because of such a great displaceability of the apparatus.

The fresh air supply conduits 15 and the exhaust gas or spent air discharge conduits 16 are formed as pipes 115 and 116 of the carriage 10 and also serve as supports and connections between a console 17 and a pipe piece 13 located above the console and supporting the mast 5. The pipe piece 13 is movable via a rotary rim 113, as will be explained hereinbelow in connection with FIG. 5.

Figure 2:
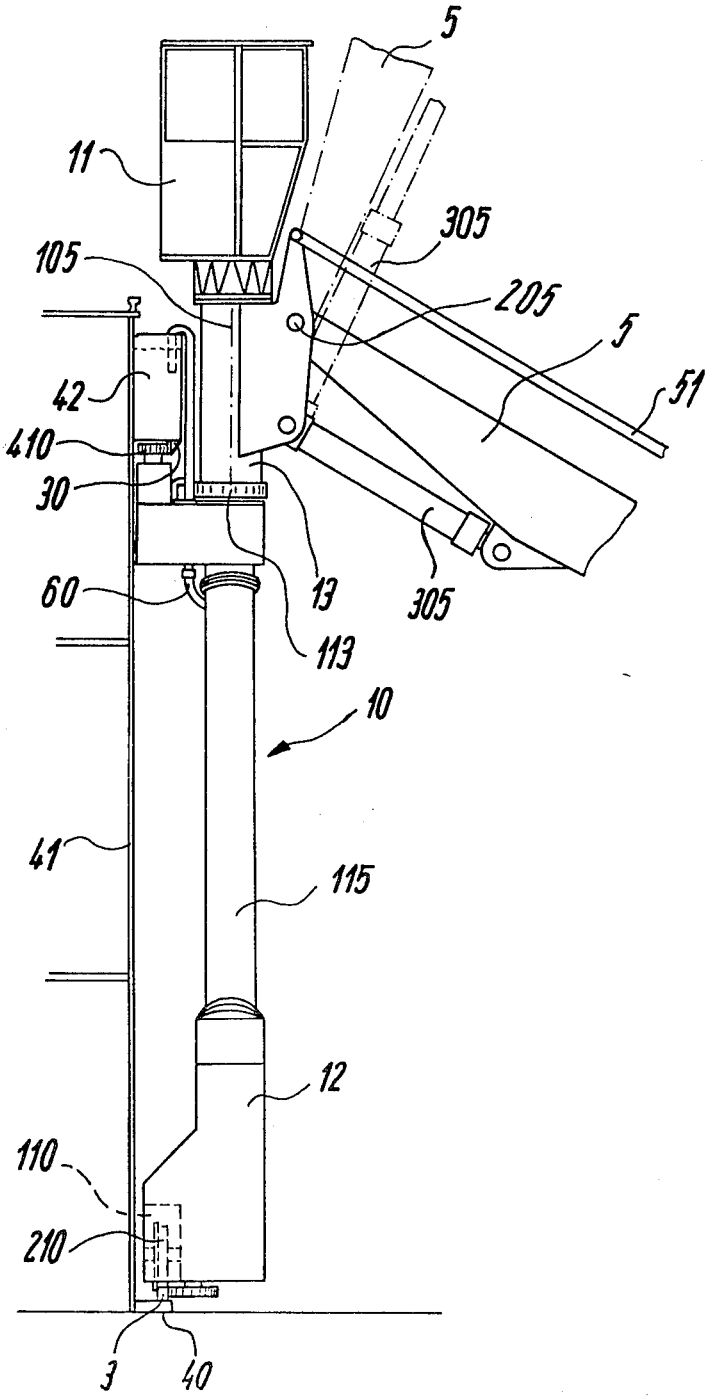
FIG. 2 is a side view of the apparatus shown in FIG. 1.

A required number of supply conduits 6 can extend from the water-tight container 12 to the upper part of the carriage or an upper water container 42 which is mounted on the vertical longitudinal wall 41 of the dock. As can be seen from FIG. 2, a water conduit 60 which belongs to the supply conduits 6 can take water from the upper water container 42 mounted on the dock 4 and supply the water to the respective aggregate in the water-tight container 12.

Figure 3:
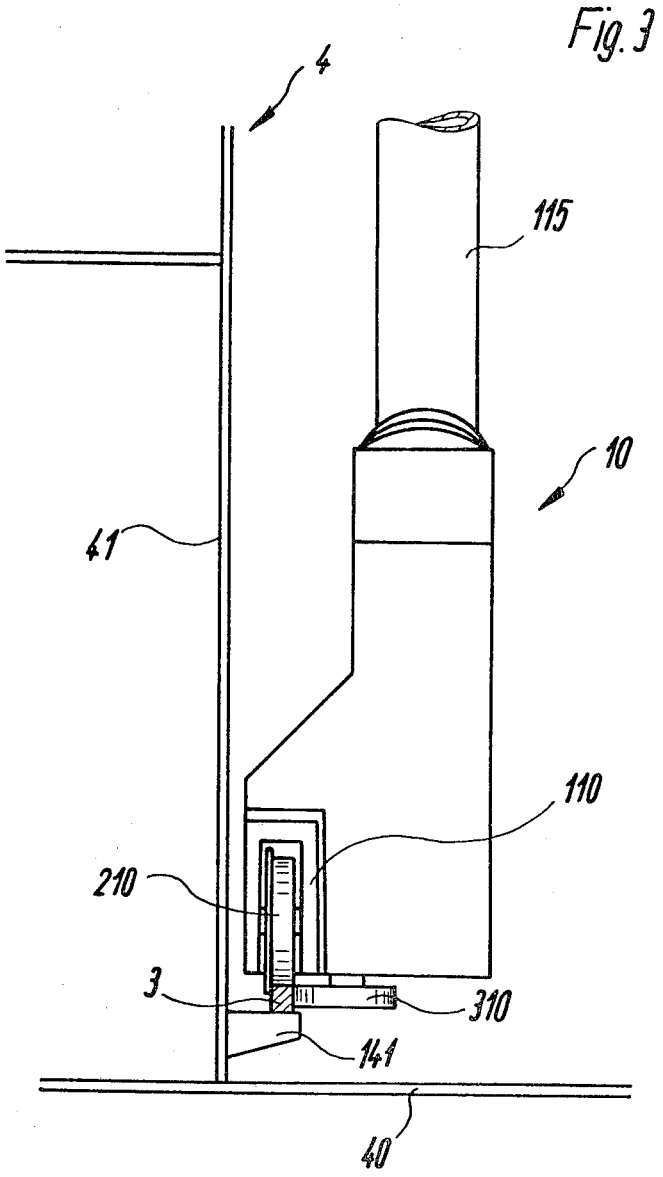
FIG. 3 is a somewhat enlarged lateral view of the lower part of the apparatus of FIG. 2.

FIG. 3 schematically shows the construction of the chassis 110. One or several neighboring coaxial rollers 210 are secured by a flange on the lower rail 3. The respective horizontal auxilliary rolls 310 provide for accurate guidance of the carriage 10, particularly the water-tight container 12 with its relatively heavy aggregates on the rail 3. In the shown example the lower rail 3 is arranged on the console 141 which extends in the horizontal direction at a distance from the dock bottom 40. This console 141 is mounted on the vertical longitudinal wall of the dock.

Figure 4:
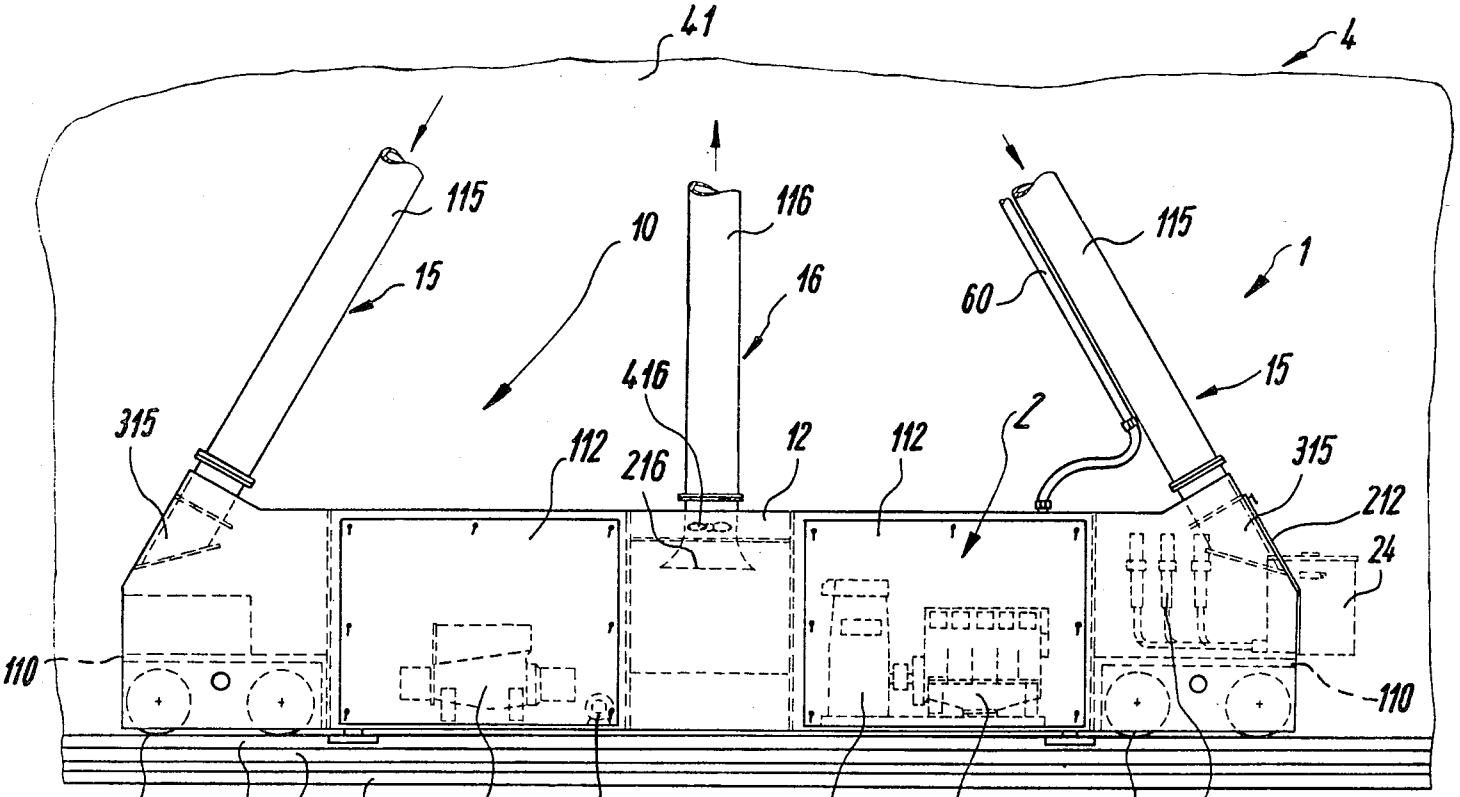
FIG. 4 is a front view of the lower part of the apparatus.

FIG. 4 shows the lower part of the apparatus 1 from the front and illustrates as an example an arrangement of the aggregates. At the right side and at the left side the chasses 110 are provided in the carriage 10 and a space therebetween is utilized for mounting the aggregates. The aggregates shown in this Figure include an internal combustion engine 20, a hydraulic station 22, a power water station 21, a paint-spraying station 23 with paint container 24 and a bilge pump 25. These aggregates are used in accordance with the respective requirements. For example, water from the water container 42 can be supplied via the water conduit 60 to the power water station 21, wherefrom the water under high pressure is supplied via non-illustrated working conduits to the mast 5 and then to the working device on the working platform of the mast. Also other media such as sand or paint can also be applied to the ship or aspirated from the ship. Each required working process can be performed in such manner.

The pipe 116 serves as an exhaust gas and spent air conduit for the aggregates arranged in the water-tight container 12 and carries an aspirating pipe piece 216 at its lower end. The pipe 115 with its issuing pipe piece 315 serves for supplying fresh air. There is a possibility to arrange conduits in the pipes 115 and 116 so that the pipes 115, 116 form stabilizing jackets for the conduits. The simple and inexpensive way is to utilize the pipes themselves as fresh air supply conduits and waste gas and spent air discharge conduits.

Figure 5:
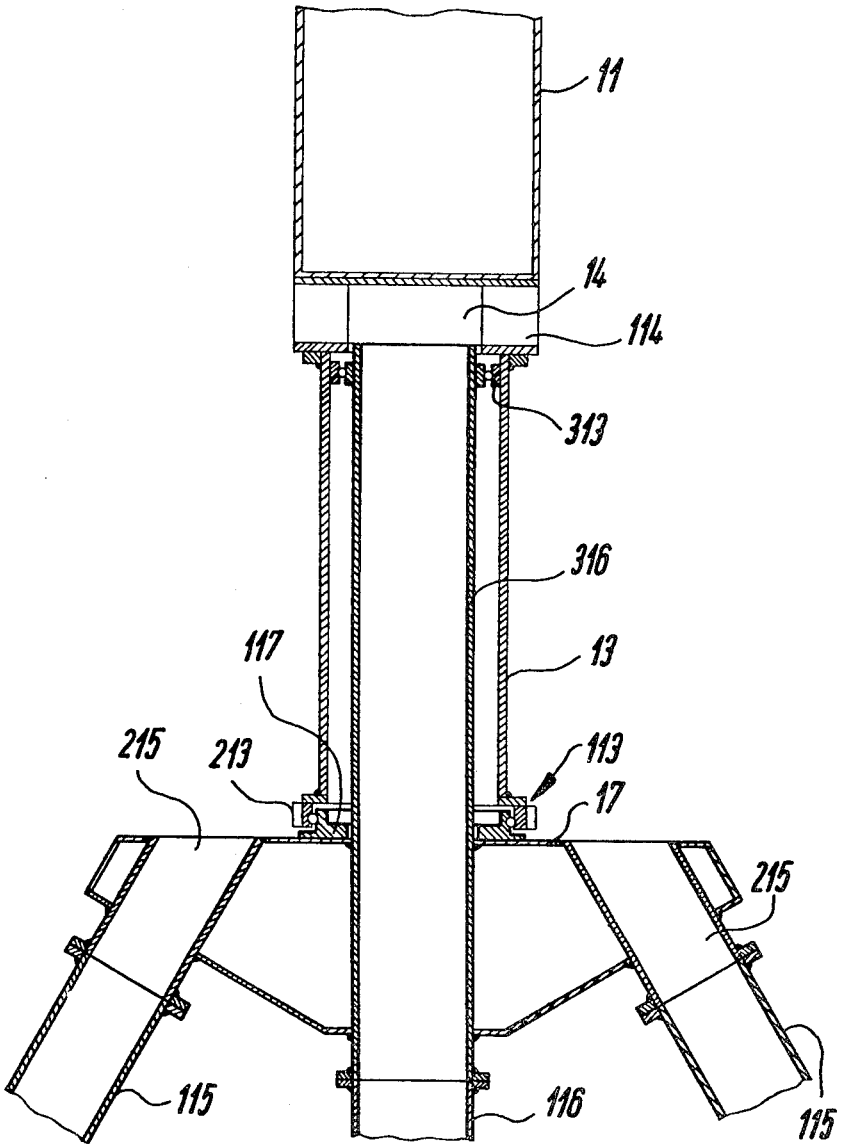
FIG. 5 is a partially sectioned front view of the central part of the apparatus.
Figure 6:
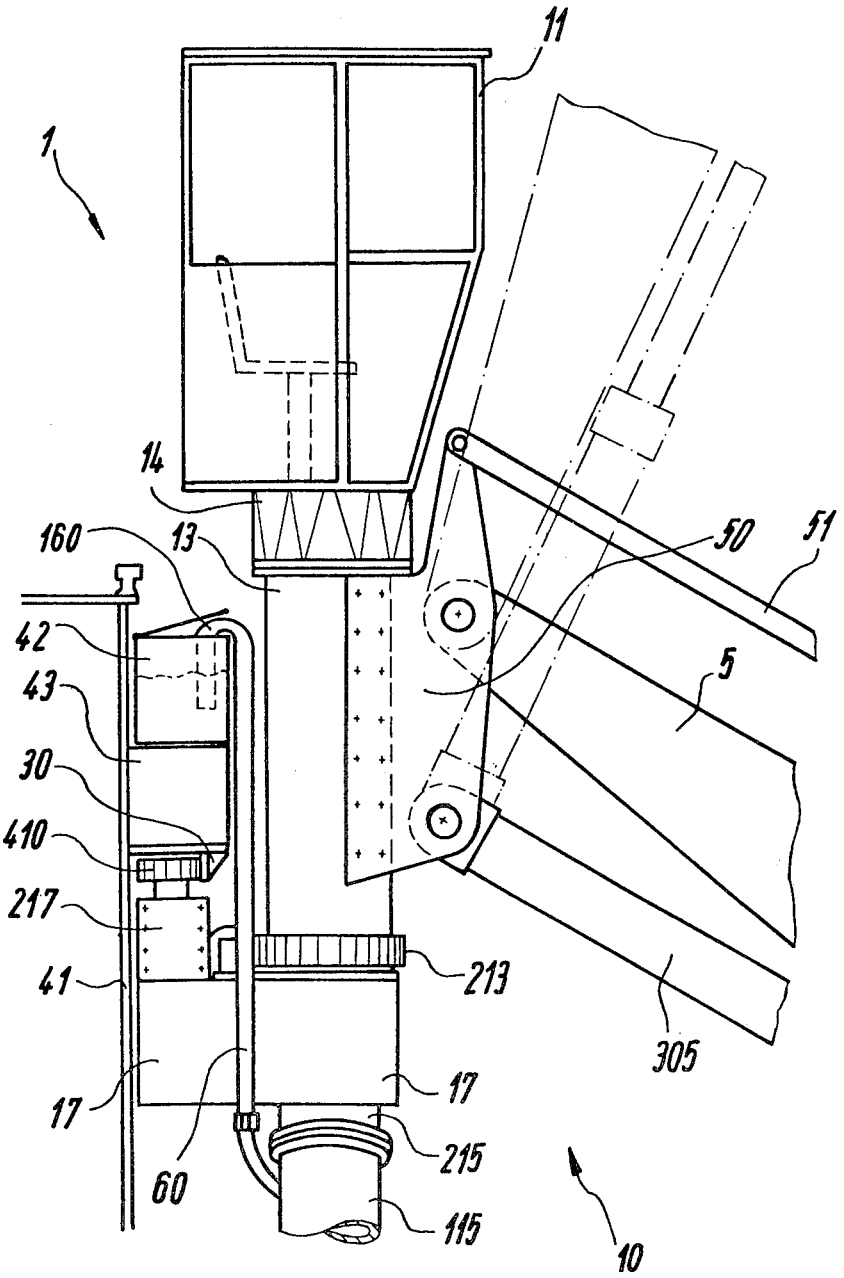
FIG. 6 is a side view of the upper part of the apparatus.

FIG. 5 shows the construction of the console 17 and the connection of the console 17 with the control cabin 11 via a ventilating ring 14. The upper ends of the pipes 115 and 116 are flanged to extensions, and more particularly the pipe 115 is connected with a receiving pipe piece 215 whereas the pipe 116 is connected with an extension pipe 316 which is surrounded by a pipe piece 13 with a distance therebetween. The pipe piece 13 serves as a support for a holder 50 which carries the mast 5. The holder 50 is fixedly connected with the pipe piece 13 as shown, for example, in FIGS. 1, 2, 6 and 7.

The extension pipe 316 of the central pipe 116 carries the console 117. On the other hand, the pipes 116 can be extended so that no extension pipe 316 is needed. The console 17 is mounted on this pipe, and the receiving pipe piece 316 of the pipe 15 for the fresh air is mounted thereon. Moreover, the console 17 carries a fixed ring 117 of a rotary rim 113 with which a toothed rim 213 of the pipe 13 is connected. The central pipe 116 or its extension 316 can be moved via a known device from the control cabin together therewith. The control cabin 11 is fixedly connected with the pipe 13 with interposition of a ventilating ring 14 and supported on the pipe 116 or its extension pipe 316 in their upper region via a ball bearing 313.

The ventilating ring 14 surrounds with a distance the upper end of the pipe 116 or its extension pipe 316. The upper end of the central pipe 116 or its extension pipe 316 opens into the ventilating ring 14 which is provided with radially extending intermediate walls or partitions 114. As mentioned above, the ventilating ring 14 is fixedly connected with the rotatably mounted pipe piece 13 on which, in turn, the mast 5 is mounted. The ventilating ring 14 carries thereby the control cabin 11 which also moves with the pipe piece 13 and the mast 5 when the drive or movement means engage the toothed rim 213 in order to provide rotary movement of the mast 5, whereby the mast can move outwardly over 180°. The console 17 is formed as a hollow body, in some cases as a ring-shaped hollow body, and forms the upper end of the V-shaped carriage 10. Upper edges of the pipe 15 or its receiving pipe piece 215 must be so located that during filling of the dock 4 from above no water can flow into the pipe.

FIG. 6 shows again the upper part of the apparatus on a somewhat greater scale. Moreover, the upper support of the carriage can be seen in FIG. 6. A member 217 is arranged on the console 17 and can receive the drive means for upper chassis rollers 410 or upper chassis roller 410. The upper chassis roller 410 supports on the upper rail 30, and more particularly the chassis roller 410 abuts against a vertical arm of the upper rail 30. The latter is mounted on an upper fender 43 extending along the longitudinal wall 41 of the dock. The above-mentioned water container 42 can be arranged on the fender.

The pipe 60 extends with its bent into the interior of the water container 42, and during the horizontal transport movement of the apparatus 1 the upper bent 160 runs in the container 42 so that water can be aspirated therefrom, for example to be supplied to a not shown working device operated by the power water station 22 under pressure and located at the free end of the mast 5.

Figure 7:
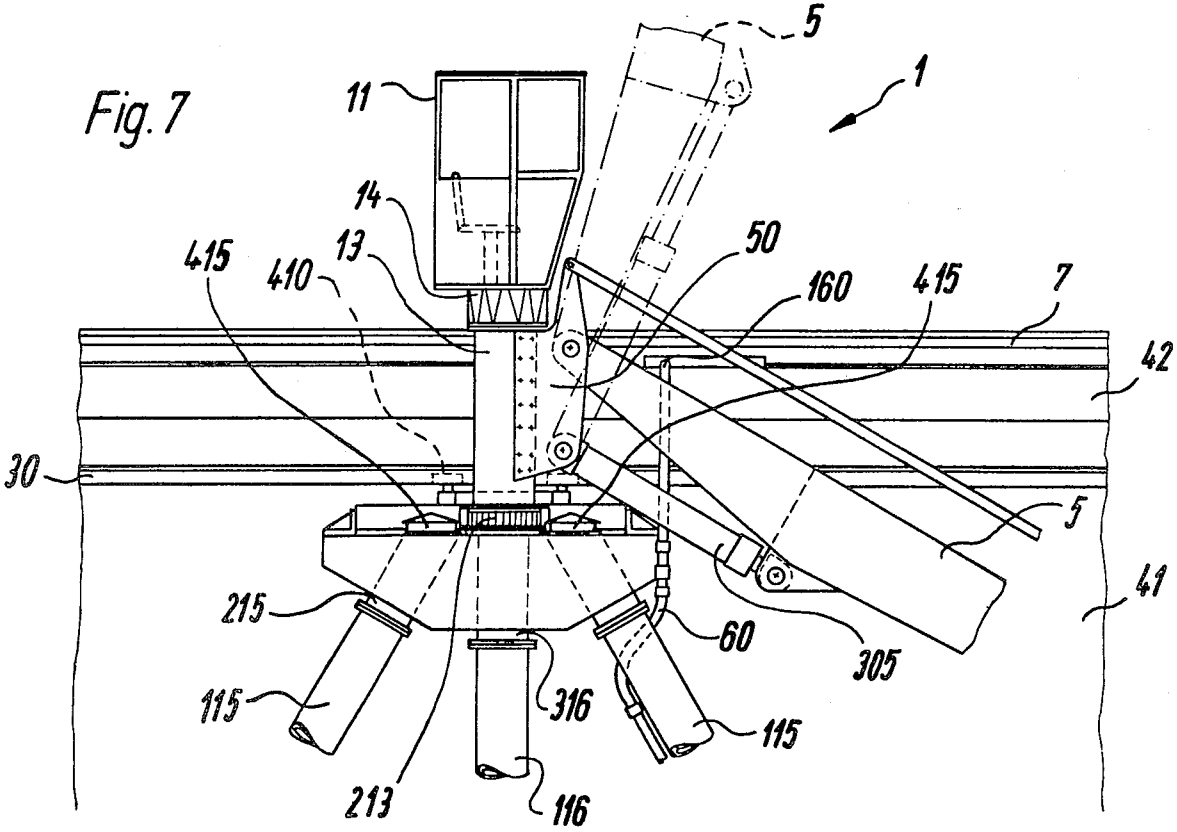
FIG. 7 is a front view of the upper part of the apparatus.

FIG. 7 shows the apparatus in the upper region in front view. It can be seen from this Figure that there is a possibility to provide the receiving pipe piece 215 with a cover 415 for preventing flowing of rain into the upper opening of the receiving pipe piece 215. As can be seen from FIGS. 6 and 7, a rail 7 can be arranged on the upper face of the vertical longitudinal wall 41 of the dock, so as to allow the crane for loading the ship to run thereover. The upper rail 7 can also in some cases be utilized for the apparatus 1; however, it is better when only rails 3 and 30 are utilized for the apparatus 1, whereby the loading crane and the apparatus can run independently from and not interfere with one another. It is also possible to provide for example an automatically operated bilge or drainage pump for accidents which can take place, so that the water-tight container 12 can be emptied by the pump when, for example, water penetrates into the container because of leakage.

The water-tight container is formed as a depressed transverse member in the carriage and corresponds to a closed unit such as a cell.

Different operations can be performed with the aid of the inventive apparatus, such as servicing, repairing, cleaning and/or painting of the ship hulls or removing algae from the ship by aspiration, etc. The supply and withdrawal conduits which are necessary for these purposes are not shown in the drawing with the exception of the water conduit 60 and can be arranged in correspondence with supply purposes and respective operations from the front of the apparatus 1 or for the respective work can be particularly raised up. It is important that the supply and withdrawal conduits extend in water-tight manner to the aggregate 2 in the interior of the water-tight container 12 and up to the maximum water upper face in the filled dock or up to the working platform or the working device to be retained there in water-tight manner. This cannot cause any problems, inasmuch as these conduits can be accommodated in surrounding hoses and the like.

Figure 8:
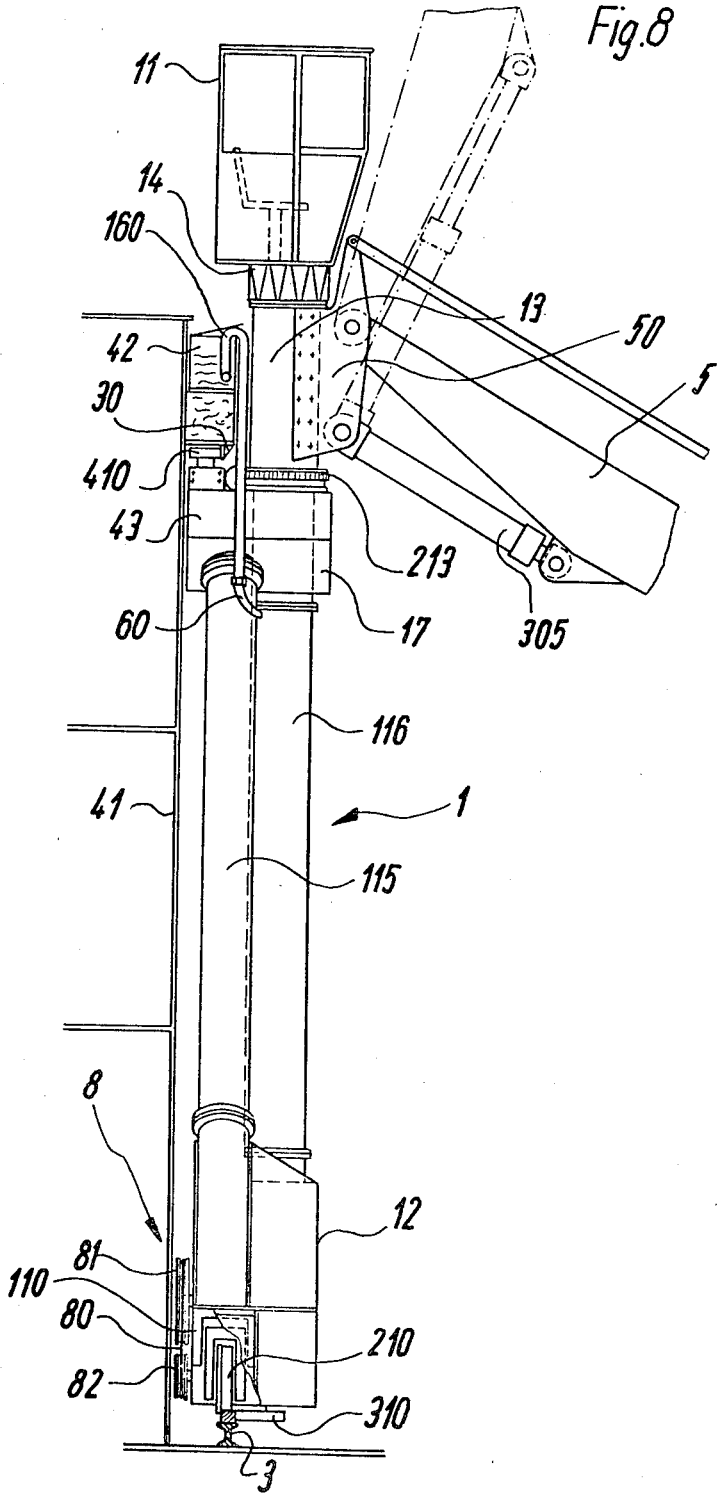
FIGS. 8–10 show a lateral view and a partial front view of two further embodiments of the present invention.

FIG. 8 shows a further very important embodiment of the invention. In this embodiment there is a possibility that the pipes 115 and 116 are offset relative to one another, particularly, the pipe 116 for exhaust gas and spent cool air serving as a support is offset forwardly, whereas the pipe 115 for fresh air supply is offset rearwardly. The toothed rim 213 with the rotary rim as well as the pipe piece 13, the ventilating ring 14 and the control cabin 11 are located in its central plane in front of the central plane of the pipe 115 for fresh air supply. As a result of this in condition of the lowered mast 5, a pivot angle in a horizontal plane can be considerably greater than 180°.

FIG. 8 further shows how the drive for movement of the entire apparatus 1, particularly the water-tight container 12, is designed. Similarly to a winch drive, the movement drive can operate via a rope, a chain or link belt 80. The movement itself can be performed in accordance with two options, either by pulling the chain, the rope or of the link belt 80 by a not shown winch or the like, or by rotary drive of a wheel 81 which can be formed as a chain wheel, rope wheel or the like. The latter option is not shown in the drawing. The drive 8 is shown in the drawing as an example. The rope 8, the chain and the like is guided via guiding rollers 82 and 83.

Figure 9:
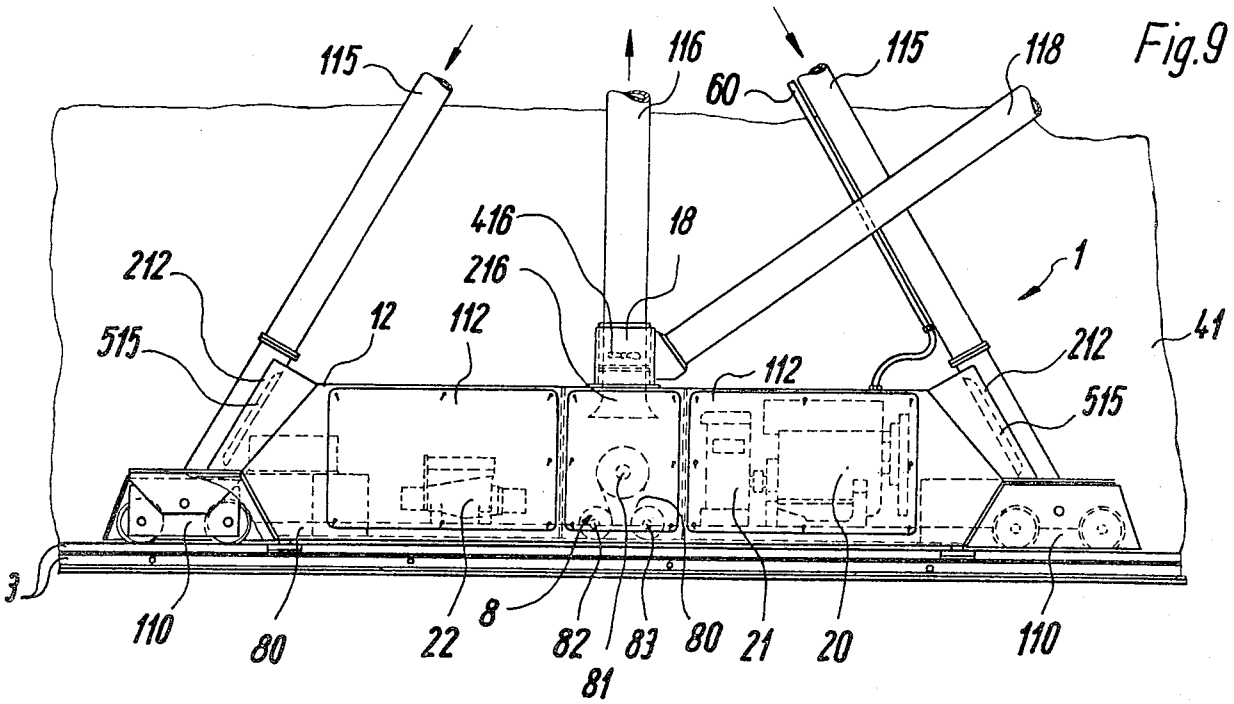

The drive 8 is illustrated in FIG. 9. This Figure shows the lower region of a further embodiment in front view. The container 12 has observation windows 112 and accommodates in its interior the required aggregates, and particularly an internal combustion engine, hydraulic aggregate, and the like. The chasses 110 are made in this embodiment somewhat heavier, in order to more reliably retain the container 12 on the bottom; also the mooring via the drive chain 80, the rope and a link belt provides for hold of the apparatus on the rail 3. In this embodiment a support pipe 118 is connected via a bearing 18 with the central pipe 116. The support pipe 118 is required for the design with an intermediate outrigger shown in FIG. 10 to support the intermediate outrigger in its vertical pivot axle.

As can be further seen from FIG. 9, it is possible that the lower part of the pipe 115 is fitted on the lateral faces 212 of the container 12. End recesses 515 are provided in the lower parts of the pipe 115. The recesses 515 extend over the entire height of the lateral face 212 in order to provide for a sufficient through cross section for the flowing in of air. This air moves to the central region of the container 12 and is then aspirated there through the aspirating pipes 216, whereby a ventilating blade 416 is associated with the aspirating pipe 216.

Figure 10:
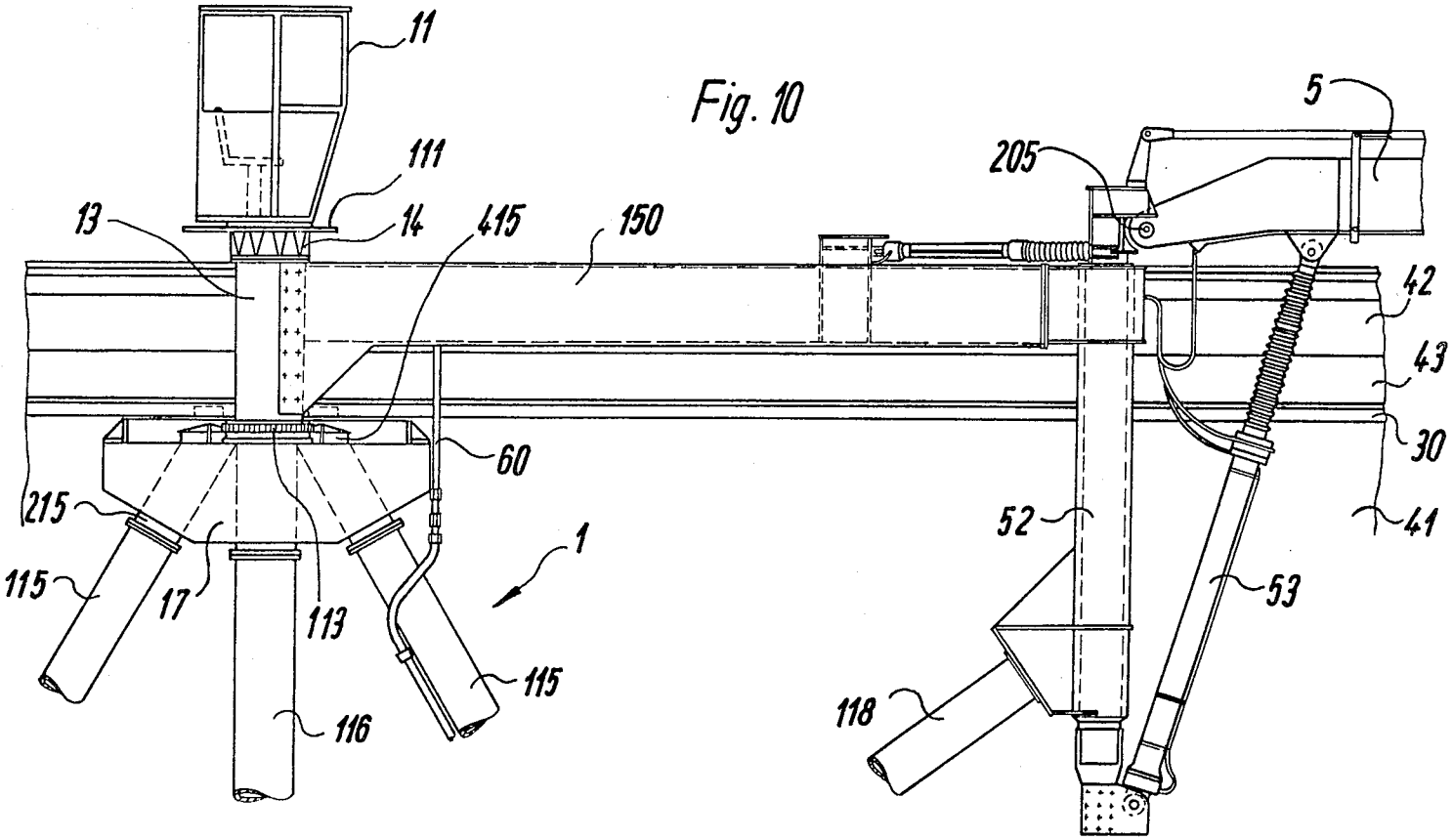

FIG. 10 shows an embodiment which also belongs to the embodiment of FIG. 9 and shows the upper region. In this embodiment, instead of the holder 50, an intermediate outrigger arm 150 is provided which is fixedly connected with the pipe piece 13 and carries the cabin 11 via the ventilating ring 14. The intermediate outrigger arm 150 forms together with the pipe piece 13 and the cabin 11 and the ventilating ring 14, a pivotable unit which is movable via the toothed rim 113.

A vertical pivot axle 52 is provided at the end of the intermediate outrigger arm 150 and supported by the supporting pipe 115. It is pivotable in vertical direction by movement element 53 about a horizontal axis 205. As can be also seen from this embodiment, the fender 43 of the water container 42 is arranged so that water can be withdrawn via the conduit 60 from the container 42 to be supplied to the respective aggregates in the container 12.

A relatively great insulating plate 111 can be arranged below the control cabin 11 so that the spent air and first of all the exhaust gas do not flow into the interior of the control cabin 11. The insulating plate 111 also allows to avoid localization of heat. Moreover, it is possible to form a cover 415 as a filter.

It is important that the pipe piece 14 serving as a central pipe can be formed with the cabin 11 and the chassis as standard parts, and in some cases also with the water-tight container 12, which forms the lower transverse traverse, so that this standard part can always be utilized. Particularly, it can be changed when needed and provided with the different aggregates. The fresh air which flows from outside into the container 12 accumulates in the central pipe of the container 12 and is transported via the aspirating pipe 260, in some cases with the active aid of the ventilator blade 416 to the region of the ventilating ring 14. All these parts can be made so as to guarantee that even in condition of bad weather no water enters thereinto.

The ventilator blade or another suitable ventilator can provide for a small vacuum in the container 12 so that air short-circuiting cannot take place in the entire system. The aspirating filter of the respective motor must be provided as close as possible to the exit locations for the fresh air, adjacent to the lateral faces 212, in which region the fresh air is supplied. On the other hand, the insulating plate 111 serves as a baffle plate and distributes the exhaust gas and spent air fast into the surrounding air.

It will be understood that each of the elements described above, or two or more together, may also find a useful application in other types of constructions differing from the types described above.

While the invention has been illustrated and described as embodied in an apparatus for treating ships' hulls in a dry dock, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for treating ship hulls in a dry dock, comprising a carriage movable horizontally on a longitudinal wall of a dry dock and having upper and lower portions; a control cabin located on said upper portion of said carriage; working means connected with said carriage and pivotable about at least one vertical and horizontal axes; working aggregates for operating the apparatus; a container located in the region of said lower portion of said carriage under water in filled condition of the dry dock, said container being water-tight and accommodating said aggregates; and a plurality of conduits including at least one fresh air supplying conduit extending to said container, and at least one exhaust gas and spent air discharging conduit extending from said container, said conduits extending up to said upper portion of said carriage.

2. An apparatus as defined in claim 1, wherein said working means and said working aggregates are arranged for servicing, repairing and cleaning of the ship hulls.

3. An apparatus as defined in claim 1, wherein said working means and working aggregates are arranged for painting the ship hulls.

4. An apparatus as defined in claim 1; and further comprising a mast connected with said carriage and having a free end which adapted to carry said working means.

5. An apparatus as defined in claim 1, wherein said working aggregates include at least one internal combustion engine, hydraulic station and power water station.

6. An apparatus as defined in claim 1, wherein said working aggregates include at least one paint spraying station and supply tank.

7. An apparatus as defined in claim 1; and further comprising a lower rail arranged on a bottom of the dry dock, said water-tight container being arranged adjacent to said lower rail and mounted on said carriage.

8. An apparatus as defined in claim 1, wherein said water-tight container accommodating said working aggregates is provided with a bilge pump.

9. An apparatus as defined in claim 1, wherein said conduits are formed as tubular members forming parts of said carriage and connecting said lower and upper portions of said carriage with one another.

10. An apparatus as defined in claim 9, wherein said plurality of conduits includes a second such fresh air supplying conduit also formed as a tubular member connecting said lower and upper portions of said carriage with one another, the tubular members formed by said supplying conduits being arranged laterally as an inverted V, whereas the tubular member formed by said discharging conduit is located centrally thereof.

11. An apparatus as defined in claim 10; and further comprising a console mounted on said central tubular member, ech of said lateral tubular members having an inlet piece fixedly connected with said console of said central tubular member.

12. An apparatus as defined in claim 11; and further comprising a tubular piece surrounding a section of said central tubular member and rotatable relative to the latter, and a mast carrying said working means and connected with said tubular piece for joint rotation therewith.

13. An apparatus as defined in claim 12, wherein said section of said central tubular member which is surrounded by said tubular piece is formed as a separate extension member of said central tubular member.

14. An apparatus as defined in claim 12; and further comprising a ring fixedly mounted on said console and having a rotary rim, said tubular piece being provided with a toothed rim connected with said rotary rim of said ring.

15. An apparatus as defined in claim 12; and further comprising an exhaust ring having radially extending partitions and connected with said rotatable tubular piece, said central tubular member having an upper end which opens into said exhaust ring.

16. An apparatus as defined in claim 15, wherein said central tubular member has a separate upper extension member which opens into said exhaust ring.

17. An apparatus as defined in claim 15, wherein said exhaust ring carries said control cabin.

18. An apparatus as defined in claim 17, and further comprising an insulating plate located under said control cabin and above said exhaust ring and forming a protective plate for said control cabin.

19. An apparatus as defined in claim 12, wherein said lateral tubular members formed by said supplying conduits are offset relative to said central tubular member formed by said discharging conduit together with said tubular piece, said central tubular member formed as a central support.

20. An apparatus as defined in claim 11, wherein said console is formed as a hollow body and forms an upper end of the inverted V of the lateral tubular members.

21. An apparatus as defined in claim 1, wherein said discharging conduit is arranged for actively transporting exhaust gas and spent air.

22. An apparatus as defined in claim 1, wherein said discharging conduit has an inlet; and further comprising a ventilating element located above said inlet of said discharging conduit and arranged for actively transporting exhaust gas and spent air.

23. An apparatus as defined in claim 22, wherein said ventilating element is a ventilator blade.

* * * * *